United States Patent [19]

Frankel et al.

[11] Patent Number: 4,701,557

[45] Date of Patent: Oct. 20, 1987

[54] 1,9-DIFLUORO-1,1,3,5,7,9,9-OCTANITRO-3,7-DIAZANONANE AND METHOD OF PREPARATION THEREOF

[75] Inventors: Milton B. Frankel, Tarzana; Edward F. Witucki, Van Nuys, both of Calif.

[73] Assignee: Rockwell International Corporation, El Segundo, Calif.

[21] Appl. No.: 407,198

[22] Filed: Aug. 11, 1982

[51] Int. Cl.[4] ..... C07C 111/00; C06B 25/34

[52] U.S. Cl. ..... 564/110; 149/92

[58] Field of Search ..... 149/92; 564/110

[56] References Cited

U.S. PATENT DOCUMENTS

| | | | |
|---|---|---|---|
| 3,423,419 | 1/1969 | Grakauskas et al. | 149/92 X |
| 3,575,973 | 4/1971 | Frankel | 149/92 X |
| 3,873,617 | 3/1975 | Adolph et al. | 149/92 X |
| 4,128,583 | 12/1975 | Wiener et al. | 149/62 X |

*Primary Examiner*—John F. Terapane
*Assistant Examiner*—Susan Wolffe
*Attorney, Agent, or Firm*—H. Fredrick Hamann; Harry B. Field

[57] ABSTRACT

1,9-Difluoro-1,1,3,5,5,7,9,9-octanitro-3,7-diazanonane, $C_7H_8F_2N_{10}O_{16}$, is disclosed as a new energetic oxidizer for solid propellants. A method for producing the new oxidizer is also disclosed.

2 Claims, No Drawings

1,9-DIFLUORO-1,1,3,5,7,9,9-OCTANITRO-3,7-DIAZANONANE AND METHOD OF PREPARATION THEREOF

BACKGROUND OF THE INVENTION

1. FIELD OF THE INVENTION

This invention relates to energetic oxidizers for solid propellants, and more specifically to an oxidizer for use in minimum smoke solid propellant systems.

2. DESCRIPTION OF THE PRIOR ART

Current solid propellant formulations use as the oxidizer, primarily, ammonium perchlorate (AP) and/or HMX. For minimum smoke propellants, where the plume signature is important, HMX is the oxidizer of choice, since HCl liberated from AP produces a very smoky exhaust. HMX, with an empirical formula of $C_4H_8N_8O_8$ is balanced to CO and $H_2O$. Since HMX is just balanced as a monopropellant, an oxygenated binder system, such as nitrocellulose/nitroglycerine, is required for use with it in order to maintain moderate propellant performance. To increase the performance potential of the oxidizer, there are two possibilities: (1) increase the positive heat of formation and/or (2) increase the oxygen content while maintaining a reasonably favorable heat of formation. The oxygen must primarily be incorporated as energetic nitro groups, since oxygenated functions such as esters and ureas have a deleterious effect on the heat of formation of the molecule.

Other property goals, besides high oxygen balance (high O/C), that must be included for an oxidizer candidate are high density, melting point greater than 100° C., and acceptable thermal stability and impact sensitivity. Of particular importance is the high density of the oxidizer, which controls the density impulse of the propellant system. HMX is unique among energetic organic compounds with a density of 1.90 g/cc. This property is one of the prime reasons for the attractiveness of HMX as an oxidizer. However, its low oxygen balance (O/C=2.0) restricts the overall energy of HMX propellant systems.

SUMMARY OF THE INVENTION

Accordingly, there is provided by the present invention a new compound 1,9-difluoro-1,1,3,5,5,7,9,9-octanitro-3,7-diazanonane and its method of preparation. This new compound is an energetic oxidizer especially useful in minimum smoke composite solid propellant systems.

OBJECTS OF THE INVENTION

Therefore, it is an object of the present invention to provide a material which can successfully replace HMX in minimum smoke solid propellant systems.

Another object of the present invention is to provide an oxidizer with a higher usable oxygen content than HMX.

Still another object of the present invention is to provide an oxidizer with a higher density than HMX.

A further object of the present invention is to provide an oxidizer that will impart improved performance to solid propellants.

A still further object of this invention is to provide 1,9-difluro-1,1,3,5,5,7,9,9-octanitro-3,7-diazanonane and a convenient method for its preparation.

Other objects, advantages and novel features of the present invention will become apparent from the following detailed description of the invention.

DESCRIPTION OF THE PREFERRED EMBODIMENTS

In accordance with the present invention, there is provided a new compound 1,9-difluoro-1,1,3,5,5,7,9,9-octanitro-3-7-diazanonane (FONN).

FONN is a viable replacement for oxidizers such as cyclotetramethylenetetranitramine (HMX) or ammonium perchlorate (AP). As shown in the table, it is an energetic oxidizer having outstanding chemical, physical, and ballistic properties. These features make its future use both highly likely and desirable.

DATA SHEET ON FONN

Name: 1 9-Difluoro-1,1,3,5,5,7,9,9-Octanitro-3,7-Diazanonane
Code: FONN
Structure: $C(NO_2)_2—\{CH_2N(NO_2)CH_2C(NO_2)_2F\}_2$
Formula: $C_7H_8F_2N_{10}O_{16}$
Molecular Weight: 526
Melting Point: 139°-140° C.
Density: 1.92 g/cc
Impact Sensitivity: 44 in-l b
Dta:
Endo: Onset/Peak: 136°/138° C.
Exo: Onset/Peak: 160°/204° C.
$\Delta H_f$: −140 kcal/mole FONN is prepared in accordance with the following reaction sequence:

$$FC(NO_2)_2CH_2OH + NH_3 \longrightarrow FC(NO_2)_2CH_2NH_2$$

$$2FC(NO_2)_2CH_2NH_2 + C(NO_2)_2—\{CH_2OH\}_2 \longrightarrow C(NO_2)_2—\{CH_2NHCH_2C(NO_2)_2F\}_2$$

$$\downarrow HNO_3$$

$$C(NO_2)_2—\{CH_2N(NO_2)CH_2C(NO_2)_2F\}_2$$

By way of illustration and not limitation, the following example is given:

EXAMPLE

Preparation of 1,9-Difluoro-1,1,3,5,5,7,9,9-Octanitro-3,7-Diazznonane

To 8.7 g (0.057 mole) of 2-fluoro-2,2-dinitroethyl amine in 15 mls of water was added drop-wise at 18° C., 4.15 g (0.025 mole) of 2,2-dinitro-1,3-propanediol in 15 mls water. Methanol was added to the resulting mixture to make it homogenous; this required approximately 30 mls. The reaction mixture was stirred at ambient temperature for 22 hours; much white solid was in evidence at this point. The solid was filtered and washed with water. The dried solid 8.6 gms (79% yield) had a melting point of 116.5° to 118° C. The infrared spectrum of this material was consistent with its proposed structure; namely:

$$C(NO_2)_2\{CH_2NHCH_2C(NO_2)_2F\}_2$$

To a mixture of 40 mls of 98% nitric acid and 40 mls of concentrated sulfuric acid was added portion-wise 4.0 g (9 mmoles) of the above described white solid. The reaction temperature during this additive rose from 14° to 20° C. The resulting reaction mixture was heated at 50° C. for three hours. The reaction mixture containing much solid at this point was cooled and then poured onto ice. The solid was filtered and washed with water until the washings were neutral. The dried, crude solid (2.3 g 48% yield) melted 136°-137° C.(d). Recrystallization from 1,2-dichloroethane raised the melting point to 139°-140° C.(d).

Elemental Analysis:

| | C | H | F |
|---|---|---|---|
| Calculated for $C_7H_8F_2N_{10}O_{16}$: | 15.97 | 1.52 | 7.22 |
| Found: | 15.97 | 1.69 | 6.80 |

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A compound denoted as 1,9-difluoro-1,1,3,5,5,7,9,9-octanitro-3,7-diazanonane and having the structural formula $C(NO_2)_2—\{CH_2N(NO_2)CH_2C(NO_2)_2F\}_2$.

2. A method of preparing 1,9-difluoro-1,1,3,5,5,7,9,9-octanitro-3,7-diazanonane comprises the following reaction sequence:

$$FC(NO_2)_2CH_2OH + NH_3 \longrightarrow FC(NO_2)_2CH_2NH_2$$

$$2FC(NO_2)_2CH_2NH_2 + C(NO_2)_2—\{CH_2OH\}_2 \longrightarrow C(NO_2)_2—\{CH_2NHCH_2C(NO_2)_2F\}_2$$

$$\downarrow HNO_3$$

$$C(NO_2)_2—\{CH_2N(NO_2)CH_2C(NO_2)_2F\}_2.$$

* * * * *

UNITED STATES PATENT AND TRADEMARK OFFICE

CERTIFICATE OF CORRECTION

PATENT NO. : 4,701,557

DATED : Oct. 20, 1987

INVENTOR(S) : Milton B. Frankel et al

It is certified that error appears in the above-identified patent and that said Letters Patent is hereby corrected as shown below: On the Title Page, Item [54]

Title should read: 1,9-DIFLUORO-1,1,3,5,5,7,9,9-OCTANITRO-3,7-DIAZANONANE AND METHOD OF PREPARATION THEREOF

Signed and Sealed this

Fourteenth Day of June, 1988

*Attest:*

DONALD J. QUIGG

*Attesting Officer*

*Commissioner of Patents and Trademarks*